US010027050B2

(12) United States Patent
Rangi et al.

(10) Patent No.: US 10,027,050 B2
(45) Date of Patent: Jul. 17, 2018

(54) INNER HOUSING FOR ELECTRICAL CONNECTOR TERMINAL CAVITY

(71) Applicant: Lear Corporation, Southfield, MI (US)

(72) Inventors: Bhupinder Rangi, Novi, MI (US); Lewis Galligan, Novi, MI (US); David Menzies, Linden, MI (US); Michael Glick, Farmington Hills, MI (US)

(73) Assignee: LEAR CORPORATION, Southfield, MI (US)

( * ) Notice: Subject to any disclaimer, the term of this patent is extended or adjusted under 35 U.S.C. 154(b) by 0 days.

(21) Appl. No.: 15/380,351

(22) Filed: Dec. 15, 2016

(65) Prior Publication Data

US 2018/0175536 A1 Jun. 21, 2018

(51) Int. Cl.
*H01R 13/424* (2006.01)

(52) U.S. Cl.
CPC ..... *H01R 13/424* (2013.01)

(58) Field of Classification Search
CPC ..... H01R 13/424
USPC ..... 439/686
See application file for complete search history.

(56) References Cited

U.S. PATENT DOCUMENTS

| | | | | |
|---|---|---|---|---|
| 4,596,436 | A * | 6/1986 | Kraemer | H01R 13/639 439/680 |
| 7,485,012 | B2 * | 2/2009 | Daugherty | H01R 13/514 439/540.1 |
| 8,764,486 | B2 | 7/2014 | Li | |
| 9,270,067 | B2 | 2/2016 | Lin et al. | |
| 9,293,853 | B2 | 3/2016 | Endo et al. | |
| 9,332,668 | B2 | 5/2016 | Nishio et al. | |

* cited by examiner

*Primary Examiner* — Harshad C Patel
(74) *Attorney, Agent, or Firm* — MacMillan, Sobanski & Todd, LLC

(57) ABSTRACT

An electrical connector assembly includes an electrical connector that defines a terminal cavity. The terminal cavity extends from an insertion opening to a mating opening. An inner housing is positioned in the terminal cavity. The inner housing defines an inner cavity. The inner cavity extends from an inner insertion opening to an inner mating opening. The inner mating opening is adjacent to the mating opening of the electrical connector. An electrical terminal is positioned in the inner cavity. A mating portion of the electrical terminal is adjacent the inner mating opening.

11 Claims, 3 Drawing Sheets

INNER HOUSING FOR ELECTRICAL CONNECTOR TERMINAL CAVITY

BACKGROUND OF THE INVENTION

The present invention relates in general to an inner housing for use with an electrical connector. More specifically, this invention relates to an inner housing that allows a cavity of an electrical connector to hold multiple electrical terminals.

Vehicles, such as passenger cars, include a variety of electrical components that are provided for the operation of the vehicle, as well as for the comfort and convenience of occupants. The vehicle includes electrical connections to provide power and control signals for these electrical components. These electrical connections include wires, terminals, and connectors that house the terminals.

As technology has advanced, vehicles include a larger number of electrical components. As a result, vehicles require more electrical connections. This can include connections for providing power, as well as connections for providing control signals. Additionally, as electrical components become more efficient, they can be powered using smaller electrical connections. Also, the electrical connections used for control signals are typically lower power than power connections. As a result, vehicles have an increasing need for a larger number of smaller electrical connections.

The parts of vehicle electrical connections, including the terminals and housings, are tested and approved by manufacturers before being used on a vehicle. These components are typically specified for use on a vehicle model over several years. When a component is changed, it is tested to determine that it meets the manufacturer's requirements as well as to obtain any pertinent certification, which can add cost and delay to the manufacturing process. As a result, it can be desirable to the manufacturer to continue to use components that are already proven. It would be advantageous to use existing electrical components, while increasing the number of electrical connections that are made with those components.

SUMMARY OF THE INVENTION

This invention relates to an electrical connector assembly. The electrical connector assembly includes an electrical connector that defines a terminal cavity. The terminal cavity extends from an insertion opening to a mating opening. An inner housing is positioned in the terminal cavity. The inner housing defines an inner cavity. The inner cavity extends from an inner insertion opening to an inner mating opening. The inner mating opening is adjacent to the mating opening of the electrical connector. An electrical terminal is positioned in the inner cavity. A mating portion of the electrical terminal adjacent the inner mating opening.

This invention also relates to an electrical connector assembly. The electrical connector assembly includes an electrical connector. The electrical connector defines a terminal cavity. The terminal cavity extends from an insertion opening to a mating opening. An inner housing is positioned in the terminal cavity. The inner housing defines an inner cavity. The inner cavity extends from an inner insertion opening to an inner mating opening. The inner mating opening is adjacent to the mating opening of the electrical connector. The inner housing also defines a second inner cavity. The second inner cavity extends from a second inner insertion opening to a second inner mating opening. The second mating opening is adjacent to the mating opening of the electrical connector. A terminal lock retains the inner housing in the terminal cavity. A secondary lock attached to the electrical connector prevents release of the terminal lock. An electrical terminal is positioned in the inner cavity. A mating portion of the electrical terminal is adjacent the inner mating opening. A second electrical terminal is positioned in the second inner cavity. A second mating portion of the second electrical terminal is adjacent the second inner mating opening.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
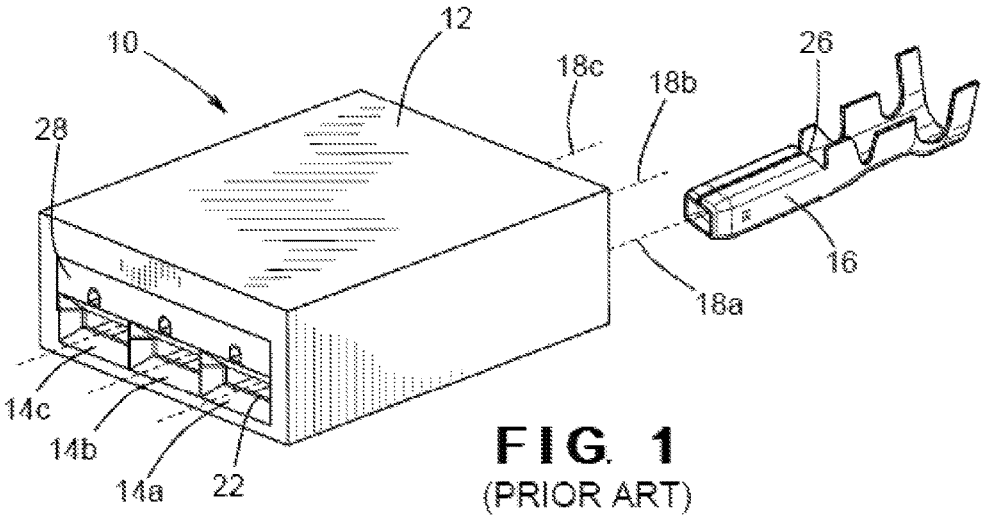
FIG. 1 (PRIOR ART)
FIG. 1 is a perspective view of a conventional three-way electrical connector and a female electrical terminal for use therein.

Referring now to the drawings, there is illustrated in FIG. 1 a conventional electrical connector, indicated generally at 10. The electrical connector 10 includes a body 12 and three terminal cavities 14*a*, 14*b*, and 14*c*. Each of the terminal cavities 14*a*, 14*b*, and 14*c* is adapted to accommodate an electrical terminal 16. The illustrated electrical connector 10 is a three-way connector and is provided as one example of an electrical connector suitable for use with this invention. However, the electrical connector 10 may include any desired number of terminal cavities. The illustrated electrical terminal 16 is a 2.8 mm female electrical terminal, and the electrical connector 10 is adapted to accommodate the female electrical terminal 16. The electrical connector 10 may be adapted to accommodate any desired size of electrical terminal 16 and may be adapted to accommodate male electrical terminals, if desired. The electrical connector 10 is adapted to be mated with a corresponding connector in a way that is known in the art in order to mate the electrical terminal 16 with a corresponding electrical terminal (not shown) housed in the corresponding connector. In use, the electrical connector 10 may include one, two, or three electrical terminals 16, depending on the number of electrical connections desired.

Figure 2:
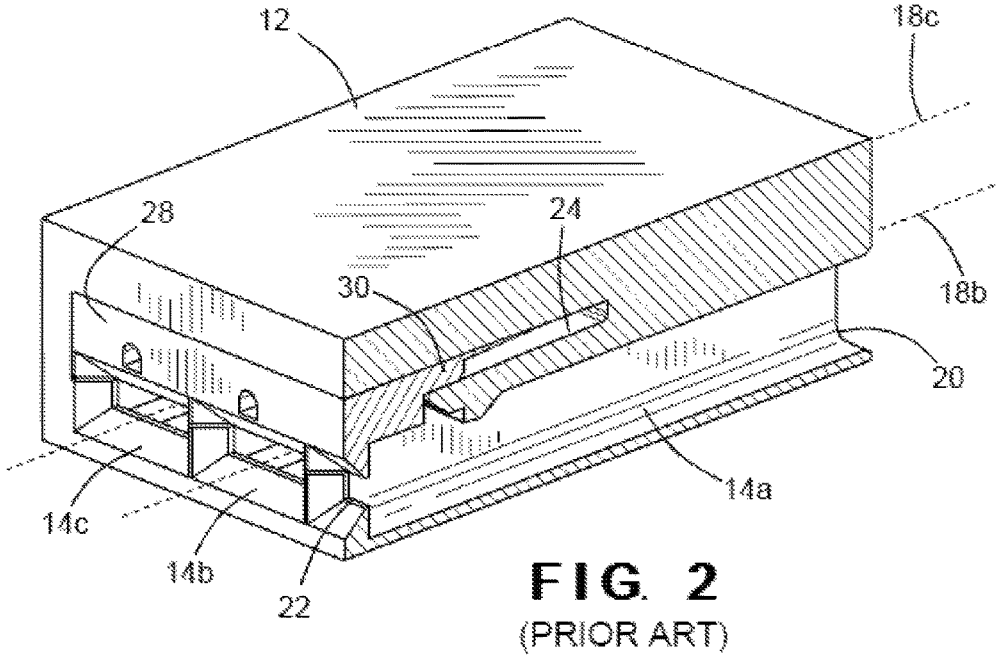
FIG. 2 (PRIOR ART)
FIG. 2 is a cut-away view of the three-way electrical connector showing the cross-section of a first terminal cavity thereof.

Referring now to FIG. 2, a cut-away view of the electrical connector 10 is shown, cut along the length of the terminal cavity 14*a*. The terminal cavity 14*a* extends along a cavity axis 18*a* (see FIG. 1) from an insertion opening 20 to a mating opening 22. The terminal cavities 14*b* and 14*c* extend along respective cavity axes 18*b* and 18*c* from similar insertion openings to similar mating openings. The terminal cavity 14*a* includes a terminal lock 24 that serves to retain the electrical terminal 16 in an installed position within the terminal cavity 14*a*. The illustrated terminal lock 24 is a deflectable arm, but may be any desired locking mechanism. As is known, the electrical terminal 16 is placed in the installed position within the terminal cavity 14*a* by being inserted into the terminal cavity 14*a* through the insertion opening 20. The terminal lock 24 is deflected by the electrical terminal 16 and rebounds to engage a catch 26 on the electrical terminal 16, as shown in FIG. 1.

The electrical connector 10 also includes an optional secondary lock 28. As is known, the secondary lock 28 is inserted into the body 12 after the electrical terminal 16 is in the installed position. The secondary lock 28 includes a locking flange 30 that blocks deflection of the terminal lock 24 in order to prevent the terminal lock 24 from releasing the electrical terminal 16. The secondary lock 28 also acts as a terminal position assurance. If the electrical terminal 16 is not fully inserted to the installed position, the terminal lock 24 will not fully rebound to engage the catch 26, and the locking flange 30 will butt against the terminal lock 24 to prevent insertion of the secondary lock 28 into the body 12, as is known. In the illustrated embodiment, a single secondary lock 28 is provided for all three terminal cavities 14*a*, 14*b*, and 14*c*, but the electrical connector 10 may include any desired number of secondary locks 28.

Figure 3:
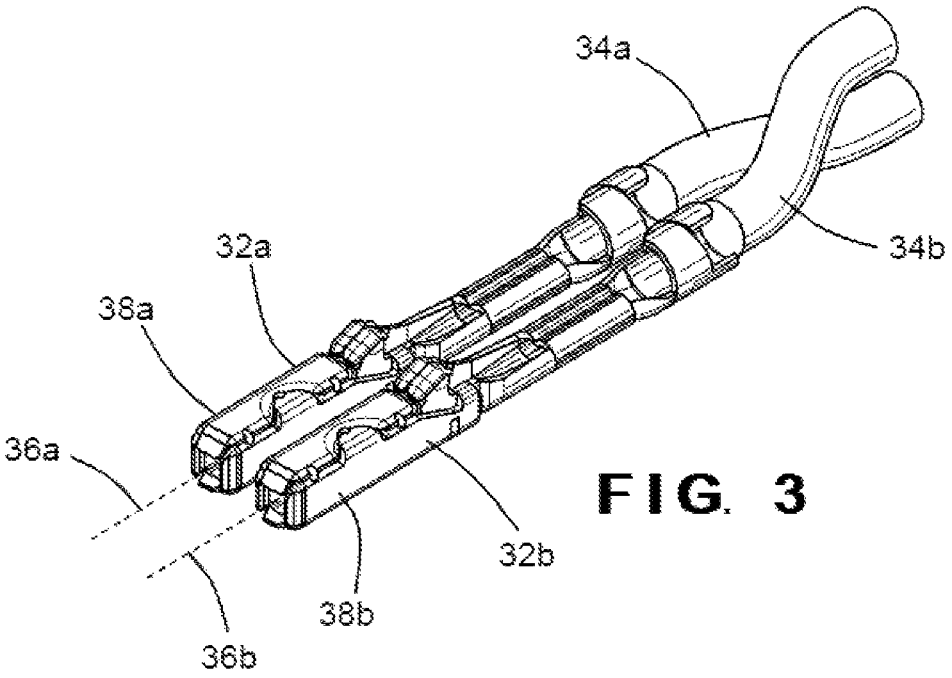
FIG. 3 is a perspective view of two female electric terminals.

Referring to FIG. 3, there is shown a perspective view of a replacement electrical terminal 32*a* and a second replacement electrical terminal 32*b*. The replacement electrical terminal 32*a* and the second replacement electrical terminal 32*b* are substantially identical and, therefore, will not be described separately. The replacement electrical terminal 32*a* will be described in detail, and similar components of the second replacement electrical terminal 32*b* will be identified on the drawings by the similar number with the "b" suffix.

The illustrated replacement electrical terminal 32*a* is a 0.5 mm female electrical terminal. However, the replacement electrical terminal 32*a* may be any desired size, and may be any desired type of electrical connector. The replacement electrical terminal 32*a* is attached to a wire 34*a* by crimping, but may be attached to any desired conductor by any desired type of connector. The replacement electrical terminal 32*a* extends along a replacement terminal axis 36*a* and is adapted to mate with a replacement corresponding terminal (not shown) inserted into a mating portion 38*a*.

Figure 4:
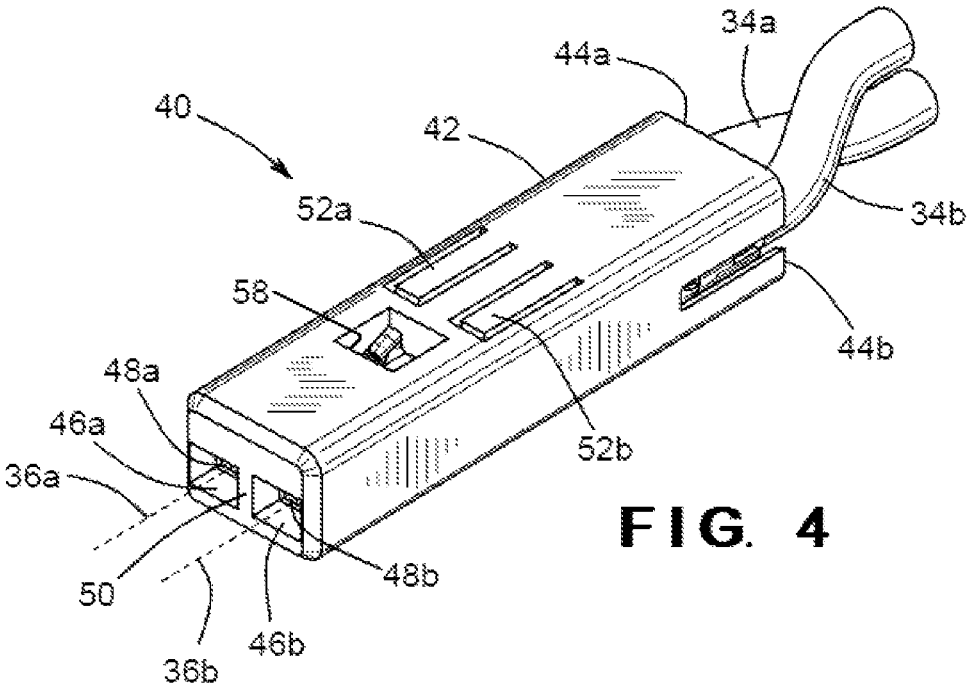
FIG. 4 is a perspective view of an inner housing that contains the two female electric terminals.

Referring to FIG. 4, a perspective view of an inner housing, indicated generally at 40, is shown. The illustrated inner housing 40 is a single piece molded from plastic, but may be made of any desired material and by any desired method. The inner housing 40 includes a body 42. The inner housing 40 defines an inner cavity 48*a* that extends from an inner insertion opening 44*a* to an inner mating opening 46*a*. The inner housing 40 also defines a second inner cavity 48*b*, which is separated from the first inner cavity 48*a* by an optional inner wall 50. The inner cavity 48*a* will be described in detail, and similar components of the second inner cavity 48*b* will be identified on the drawings by the similar number with the "b" suffix. Although not visible in FIG. 4, the replacement electrical terminal 32*a* is located in the inner cavity 48*a*, with the mating portion 38*a* adjacent to the inner mating opening 46 of the inner housing 40. Similarly, the second replacement electrical terminal 32*b* is located in the second inner cavity 48*b*.

The inner housing 40 includes an inner terminal lock 52*a*, which serves to retain the replacement electrical terminal 32*a* in an installed position in the inner cavity 48*a*. The illustrated inner terminal lock 52*a* is a deflectable arm, but may be any desired locking mechanism. The replacement electrical terminal 32*a* is placed in the installed position within the inner cavity 48*a* by being inserted into the inner cavity 48*a* through the inner insertion opening 44*a* of the inner housing 40. The inner terminal lock 52*a* is deflected by the replacement electrical terminal 32*a* and rebounds to engage a terminal catch 54*a* on the replacement electrical terminal 32*a*, shown in FIG. 3. Alternatively, the replacement electrical terminal 32*a* may be retained in the inner housing 40 by making the replacement electrical terminal 32*a* integral with the inner housing 40, for example, by molding the inner housing 40 around the replacement electrical terminal 32*a*.

Figure 5:
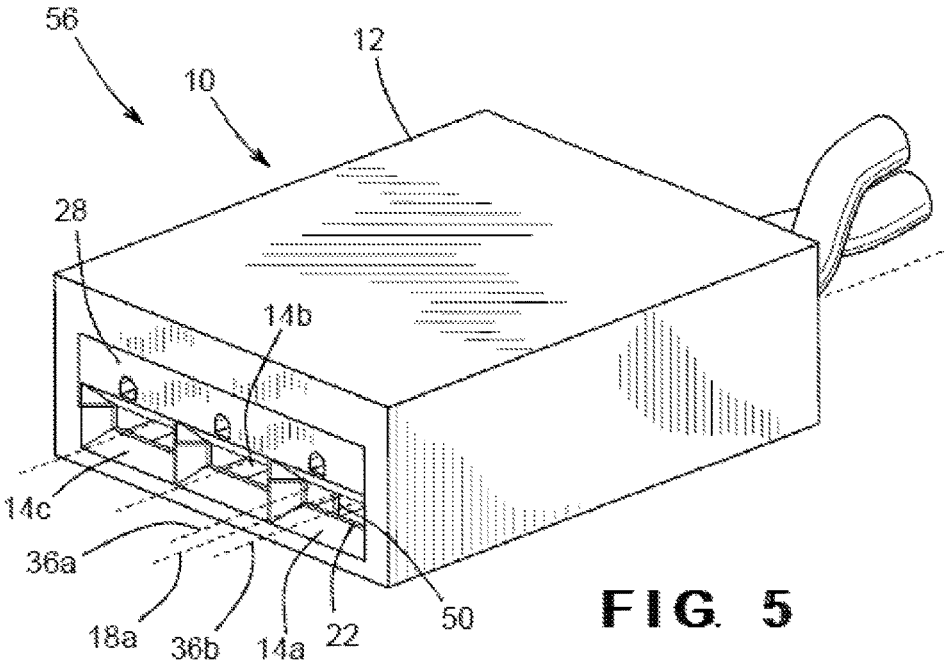
FIG. 5 is a perspective view of an electrical connector assembly which includes the three-way electrical connector and the inner housing positioned in one of the terminal cavities.
Figure 6:
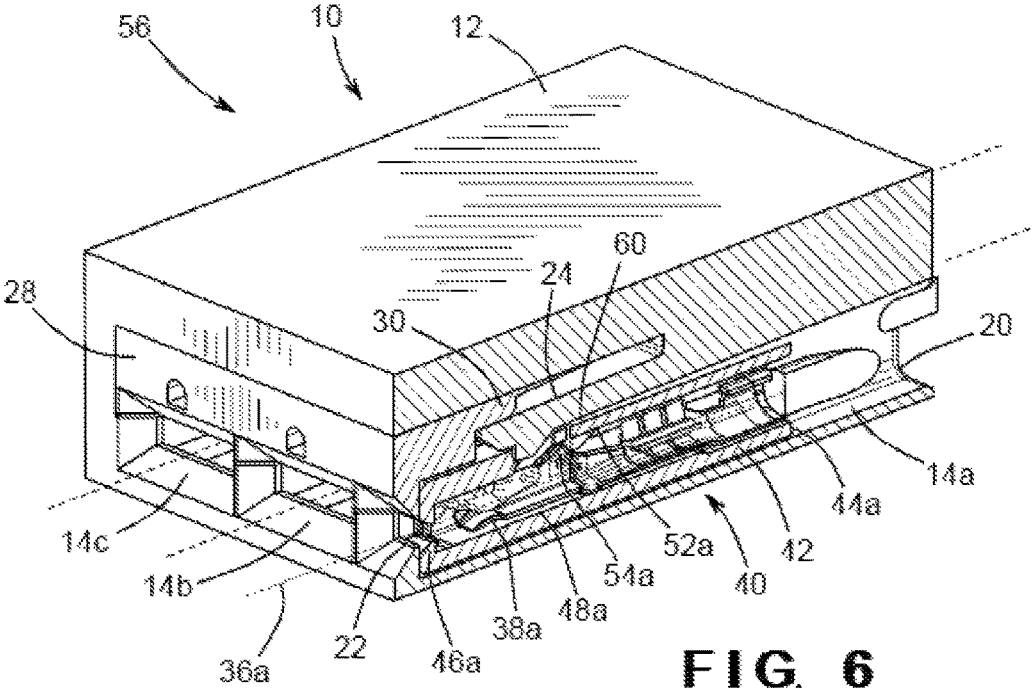
FIG. 6 is a cut-away view of the electrical connector assembly.

Referring to FIG. 5, a perspective view of an electrical connector assembly, indicated generally at 56, is shown. The electrical connector assembly 56 includes the electrical connector 10 with the inner housing 40 positioned in the terminal cavity 14*a*. A cut-away view of the electrical connector assembly 56 is shown in FIG. 6, cut along the centerline of the inner cavity 48*a*. A wall 60 of the terminal cavity 14*a* blocks deflection of the inner terminal lock 52*a* and acts as an inner secondary lock to prevent the replacement electrical terminal 32*a* from being removed from the inner housing 40. In the illustrated embodiment, the wall 60 is the terminal lock 24, but may be any desired portion of the terminal cavity 14*a*.

The terminal lock 24 in the terminal cavity 14*a* also serves to retain the inner housing 40 in an installed position within the terminal cavity 14*a*. The inner housing 40 is placed in the installed position within the terminal cavity 14*a* by being inserted into the terminal cavity 14*a* through the insertion opening 20. The terminal lock 24 is deflected by the inner housing 40 and rebounds to engage a housing catch 58 on the inner housing. Additionally, the secondary lock 28 of the electrical connector 10 will prevent the inner housing 40 from being removed from the terminal cavity 14*a* and will also act as a position assurance for the inner housing 40. If the inner housing 40 is not fully inserted to the installed position, the terminal lock 24 will not fully rebound to engage the housing catch 58 and the locking flange 30 will butt against the terminal lock 24 to prevent insertion of the secondary lock 28 into the body 12.

The replacement electrical terminal 32*a* is positioned in the terminal cavity 14*a* so that the replacement terminal axis 36*a* is substantially parallel to the cavity axis 18*a*. The replacement terminal axis 36*a* is oriented to pass through the mating opening 22 of the electrical connector 10. Additionally, the second replacement electrical terminal 32*b* is positioned in the terminal cavity 14*b* so that the second replacement terminal axis 36*b* is substantially parallel to the cavity axis 18*b*. The second replacement terminal axis 36*b* is also oriented to pass through the mating opening 22 of the electrical connector 10.

The electrical connector assembly 56 is illustrated with one inner housing 40 placed in one terminal cavity 14*a*, but the illustrated electrical connector assembly 56 may have additional inner housings 40 placed in the other terminal cavities 14*b* and 14*c*. Although not shown, the corresponding connector will have similar modifications in order to house electrical terminals that correspond to the replacement electrical terminal 32*a* and the second replacement electrical terminal 32*b*. The use of the inner housing 40 allows the electrical connector assembly 56 to house a larger number of electrical terminals, while still utilizing the same electrical connector 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

an electrical connector defining a terminal cavity that extends from an insertion opening to a mating opening and that includes an integral terminal lock that extends into the terminal cavity;

an inner housing positioned in the terminal cavity, the inner housing defining an inner cavity that extends from an inner insertion opening to an inner mating opening that is adjacent to the mating opening of the electrical connector, the integral terminal lock of the electrical connector engaging the inner housing and thereby preventing the inner housing from being removed from the terminal cavity; and an electrical terminal positioned in the inner cavity with a mating portion of the electrical terminal adjacent the inner mating opening.

2. The electrical connector assembly of claim 1, wherein the inner housing includes an inner terminal lock that retains the electrical terminal in the inner cavity.

3. The electrical connector assembly of claim 2, wherein a wall of the electrical connector is a secondary lock to prevent release of the inner terminal lock.

4. The electrical connector assembly of claim 1, wherein the inner housing defines a second inner cavity and a second electrical terminal is positioned in the second inner cavity with a second mating portion adjacent the mating opening.

5. The electrical connector assembly of claim 4, wherein the terminal cavity extends along a cavity axis, the electrical terminal extends along a terminal axis that is parallel to the cavity axis, and the second electrical terminal extends along a second terminal axis that is parallel to the cavity axis.

6. The electrical connector assembly of claim 5, wherein the terminal axis extends through the mating opening of the electrical connector and the second terminal axis extends through the mating opening of the electrical connector.

7. The electrical connector assembly of claim 5, wherein the inner housing includes an inner terminal lock that retains the electrical terminal in the inner cavity and a second inner terminal lock that retains the second electrical terminal in the second inner cavity.

8. The electrical connector assembly of claim 7, wherein a wall of the electrical connector is a secondary lock to prevent release of the inner terminal lock and the second inner terminal lock.

9. An electrical connector assembly comprising:

an electrical connector defining a terminal cavity that extends from an insertion opening to a mating opening;

an inner housing positioned in the terminal cavity, the inner housing defining an inner cavity that extends from an inner insertion opening to an inner mating opening that is adjacent to the mating opening of the electrical connector;

a terminal lock formed integrally with the electrical connector and extending into the terminal cavity, the terminal lock engaging the inner housing and thereby preventing the inner housing from being removed from the terminal cavity;

a secondary lock attached to the electrical connector which blocks deflection of the terminal lock in order to prevent the inner housing from being removed from the terminal cavity;

an electrical terminal positioned in the inner cavity with a mating portion of the electrical terminal adjacent the inner mating opening.

10. The electrical connector assembly of claim 9, wherein the terminal cavity extends along a cavity axis that extends through the mating opening, the electrical terminal extends along a terminal axis that is parallel to the cavity axis and extends through the mating opening, and the second electrical terminal extends along a second terminal axis that is parallel to the cavity axis and extends through the mating opening.

11. An electrical connector assembly comprising:

an electrical connector defining a terminal cavity that extends from an insertion opening to a mating opening and that includes an integral terminal lock that extends into the terminal cavity, the electrical terminal including a catch;

an inner housing positioned in the terminal cavity, the inner housing defining an inner cavity that extends from an inner insertion opening to an inner mating opening that is adjacent to the mating opening of the electrical connector, wherein the inner housing includes an inner terminal lock; and an electrical terminal positioned in the inner cavity with a mating portion of the electrical terminal adjacent the inner mating opening, wherein the inner terminal lock retains the electrical terminal in the inner cavity and wherein the integral terminal lock of the electrical connector engages the inner housing thereby preventing the inner housing from being removed from the terminal cavity and wherein a wall of the electrical connector is a secondary lock that prevents release of the inner terminal lock thereby preventing the electrical terminal from being removed from the inner housing.

* * * * *